United States Patent [19]

Mengshoel et al.

[11] 4,328,991

[45] May 11, 1982

[54] SITTING DEVICE

[76] Inventors: Hans C. Mengshoel, Gables gate 41, N-Oslo 2; Peter Opsvik, Hogtunveien 12, N-1370 Asker, both of Norway

[21] Appl. No.: 134,217

[22] Filed: Mar. 26, 1980

[30] Foreign Application Priority Data

Mar. 30, 1979 [NO] Norway ..... 791076

[51] Int. Cl.[3] ..... A47C 3/029; A47C 7/50

[52] U.S. Cl. ..... 297/271; 297/DIG. 7; 297/423

[58] Field of Search ..... 297/423, 4, 271, 424, 297/431, 195, 258, DIG. 4, 429, DIG. 7, 259, 272, 131, 132, 426, 187

[56] References Cited

U.S. PATENT DOCUMENTS

| | | | |
|---|---|---|---|
| 2,232,958 | 2/1941 | McKenzie | 297/258 X |
| 3,037,570 | 6/1962 | Olson | 297/423 X |
| 3,541,313 | 11/1970 | Buzzi | 297/195 |
| 3,669,493 | 6/1972 | Vowels | 297/429 |
| 3,712,671 | 1/1973 | Dalton | 297/DIG. 7 |
| 3,863,978 | 2/1975 | Gillings, Jr. | 297/195 X |
| 4,065,180 | 12/1977 | Karav | 297/466 |
| 4,092,041 | 5/1978 | Landry | 297/DIG. 7 |

FOREIGN PATENT DOCUMENTS

| | | | |
|---|---|---|---|
| 821879 | 9/1969 | Canada | 297/258 |
| 718397 | 11/1931 | France | 297/259 |
| 1347216 | 2/1974 | United Kingdom | 297/423 |

*Primary Examiner*—James T. McCall

*Attorney, Agent, or Firm*—Darby & Darby

[57] ABSTRACT

A sitting device with a seat, the inclination of which may be altered relative to a floor, supporting means along being arranged below and substantially in front of said seat for the knee or calf leg portions of the user, the supporting means being arranged at the front portion of the frame of the device in the form of two cushions spaced apart to provide a free space from the front and in towards the seat, and the seat being fixedly connected to the frame, said frame being provided with substantially curved runners to contact the floor and said supporting means being arranged at the front ends of the runners. The runners may at a middle portion thereof have a bend to define a transition between sections of the runners. The sitting device may have a back rest. Instead of a fixedly connected seat and runners, the seat may be hinged connected to the frame and forwardly tiltable.

7 Claims, 24 Drawing Figures

SITTING DEVICE

The present invention relates to a sitting device with a seat, the inclination of which may be changed relative to the support (the floor) for the sitting device, with a supporting means being arranged for the knee- or calf leg portion of the user below and substantially in front of said seat.

In the industrialized part of the world one assumes a sitting posture too extensively, i.e. that one during a large portion of the day has a posture providing an angle of approximately 90° between the legs and the upper part of the body. The hip joint has difficulty in accepting an angle in excess of approximately 50°, and the remaining 40° are thus bent at the lowermost and soft portion of the spine. Upon forward bending for writing or other work, the stress on the spine becomes even greater. Such stresses are causing a number of ailments of the back. In order to overcome these problems there has now been brought into the market office chairs with a tiltable seat which may tilt forwardly and thereby increase the angle between the legs and the upper part of the body. The disadvantage of these chairs are, inter alia according to the research done by the Swedish Furniture Institute, that the user easily may slide off the seat and thereby cannot make the said angle as open as possible.

A prior art chair is known from U.S. Pat. No. 3,669,493 which is adapted to support a person so that his weight is distributed between his posterior and his knee. The chair includes a knee support and a seat support sloping generally downward towards the knee support. The sloping seat and the knee support cooperate to shift a portion of a persons weight onto the knee support so that the weight borne by the person's posterior is reduced, thus permitting use of the chair over an extended period of time without the person developing a pain in his posterior. An arcuate lateral foot rest permits the person to place his feet in a number of positions.

The inclination of the seat may be changed as well as the inclination of the knee support. However the chair is stationary on the floor and is difficult to enter, in particular with the embodiments having adjustable seat and knee support.

The present invention has therefore as an object to overcome the disadvantages related to chairs of the known types.

The sitting device according to the preferred embodiment of the present invention is characterized in that the said supporting means for the knee and/or calf are arranged at the front portion of a frame of the device in the form of two cushions spaced apart from each other and from the seat in such a manner that there is free space from the front and in towards the seat, and that said seat is hinge connected with the said frame and forwardly tiltable. According to another preferred embodiment of the invention, the said supporting means are arranged at the front portion of the frame of the device in the form of two cushions spaced apart from each other and from the seat cushion in such a manner that there is free space from the front and in towards the seat, and that the seat is fixedly connected with the said frame, said frame being provided with substantially curved runners to rest against said support, said supporting means being arranged at the front ends of said runners.

According to further features of the sitting device, the said runners have at a middle section a bend for causing the sitting device to assume one of several possible stable positions in use. The supporting means have such position and inclination that the user upon placing his knee or calf-leg resting against the supporting means may also place his feet against the floor or said runners. The sitting device is also preferably provided with a back rest.

The present invention is now to be described by way of examples with reference to the drawings.

With the present construction the sitting device may be used as a conventional chair or stool, or as a chair with a tiltable seat, e.g. a rocking chair. When the angle between the leg and the upper portion of the body is desired to be so wide that the user can slide down from the seat, the knees or the calf portion of each leg are placed against the said knee- or calf-portion supporting means. The weight of the body will then be distributed between the seat and the knee or calf support so that one avoids sitting with tensioned muscles in the legs in order not to slide off the seat. The angle between the upper portion of the body and the legs becomes in this posture approximately 135°, and even with relaxed muscles the lumbar region will not project backwards. The rocking construction has also the effect that one independently of the upper portion of the body being in balance, may rock from the lumbar region and downwards and thereby obtain an active sitting method which makes the muscles of the hip joint active.

Figure 1:
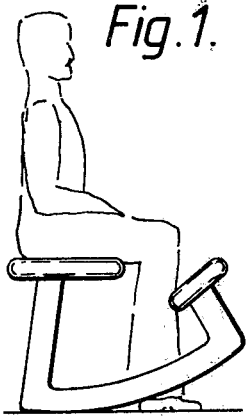
FIGS. 1–6 illustrate a first embodiment of the sitting device according to the invention.
Figure 2:
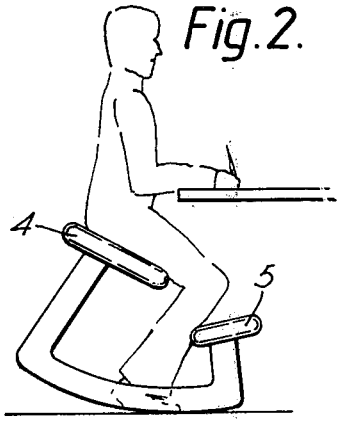
Figure 3:
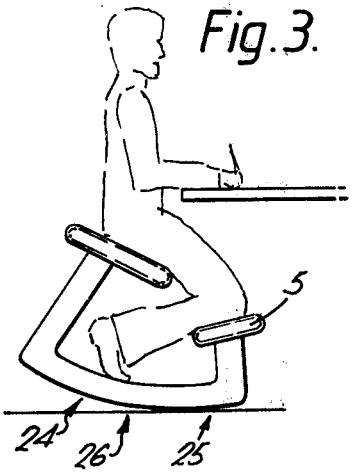
Figure 4:
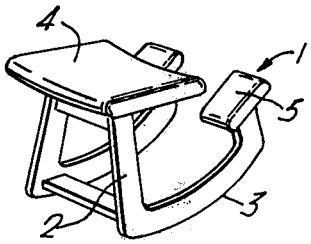
Figure 5:
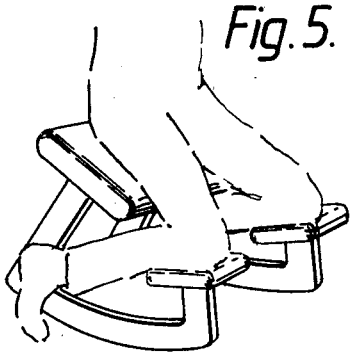
Figure 6:
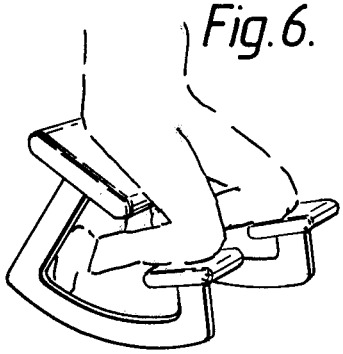
Figure 15:
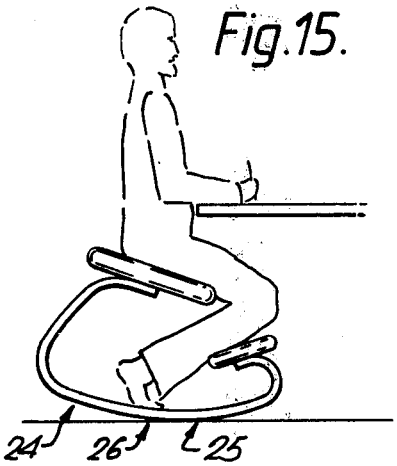
Figure 16:
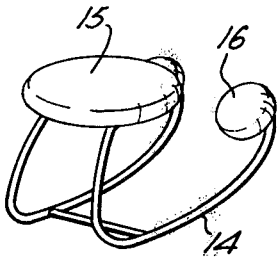
Figure 17:
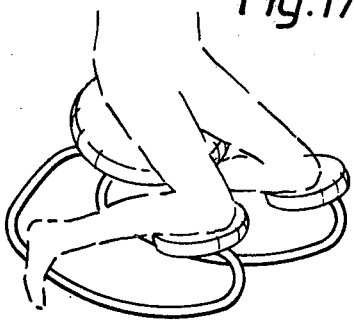
Figure 18:
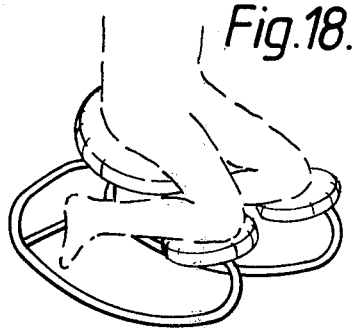

In FIGS. 1–6 there is shown a sitting device 1 having a frame 2, substantially curved runners 3 which are unitary with the frame 2, a seat 4, and knee or calf-leg supporting means 5 in the form of two spaced apart cushions. In FIG. 1 the sitting device is shown in a position where the upper body and legs of the user form an angle of approximately 90° and the legs are between the two cushions. In FIG. 2 the sitting device is caused to tilt so that the seat 4, is forwardly inclined and the calf leg portion of each of the legs of the user is then resting against the supporting means 5. In FIG. 3 as well as in FIGS. 5 and 6 the user is shown using the supporting means 5 as a knee support. As will appear from FIG. 3 the runners 3 have a bend at 26, thus making a distinct transition between the front and rear portions 24 and 25 of the runners. The same is also indicated in FIG. 15.

Figure 7:
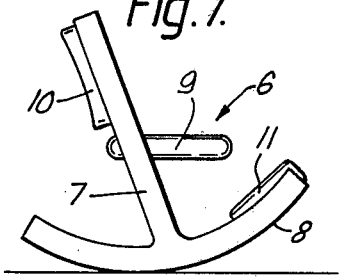
FIGS. 7–12 illustrate a second embodiment of the sitting device according to the invention.
Figure 8:
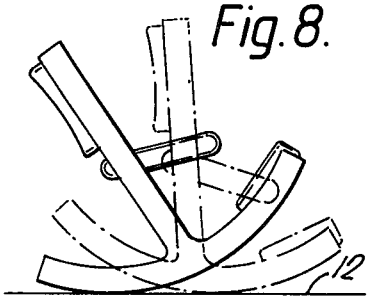
Figure 9:
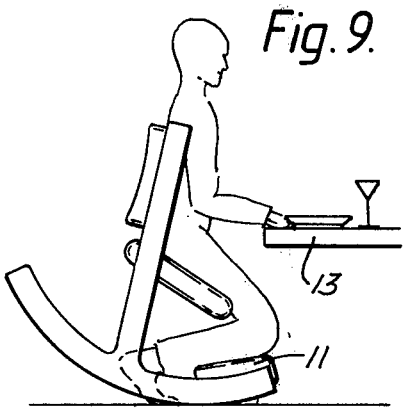
Figure 10:
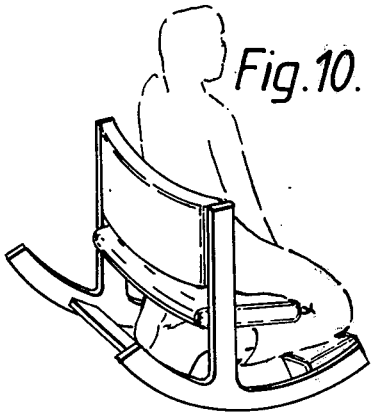
Figure 11:
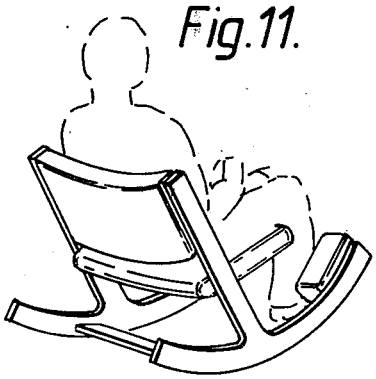
Figure 12:
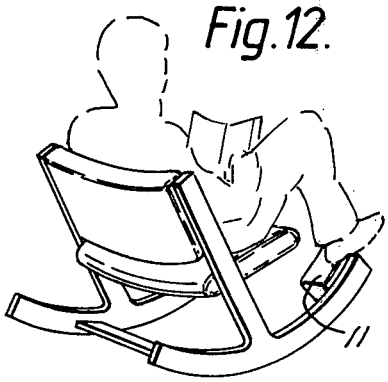
Figure 13:
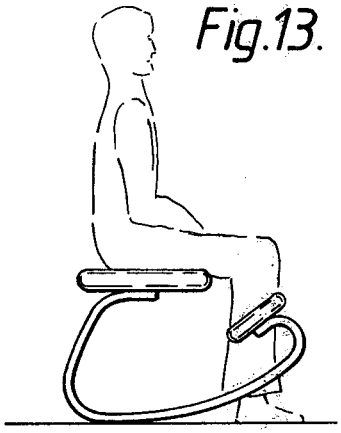
FIGS. 13–18 illustrate a modification of the sitting device shown in FIGS. 1–6.
Figure 14:
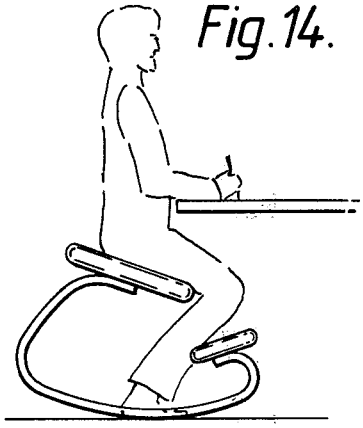

In FIGS. 7–12 the sitting device is illustrated as a rocking chair 6 where the frame 7 has curved runners 8 which are unitarily connected with the frame 7. The seat 9 forms an angle with the back rest of the chair 10, said angle being wider than 90°. On the front portions of the runners there is arranged calf supporting means 11 in the form of two spaced apart cushions. As will appear from FIG. 12 these means 11 may also be used as a foot support in case the sitting device is used as a conventional rocking chair. This is however a marginal effect of the present invention. FIG. 8 illustrates in dotted lines how the position of the chair is altered upon forwardly inclining the seat relative to the floor 12. In FIG. 9 the user sits at a table 13 and the supporting means 11 serves as shown for supporting the calf leg portion of the user. The user has here, in the chosen example, placed his feet on the outside of the runners 8. However, the user may, as shown in FIG. 10 arrange his feet on the inside of the runners. In FIG. 11 the sitting device is used as a conventional rocking chair with the feet of the user on the floor. The same is the case in FIG. 12, where, as pointed out the supporting means 11 serve to support the feet of the user.

FIGS. 13–18 illustrate an embodiment of the sitting device according to the invention, which is similar to the embodiment of FIGS. 1–6. Instead of the somewhat solid frame 2 of FIGS. 1–6, there is here chosen a frame made from e.g. steel tubes 14. The form of the seat 15 and the supporting means 16 may of course be varied within the scope of the invention. As pointed out in connection with FIG. 3 there is a bend 26 between the sections 24 and 25 of the runners, thus causing a distinct transition between said sections. The same may of course be the case as regards the embodiment shown in FIGS. 7–12 as well as in FIG. 19 to be described below.

Figure 19:
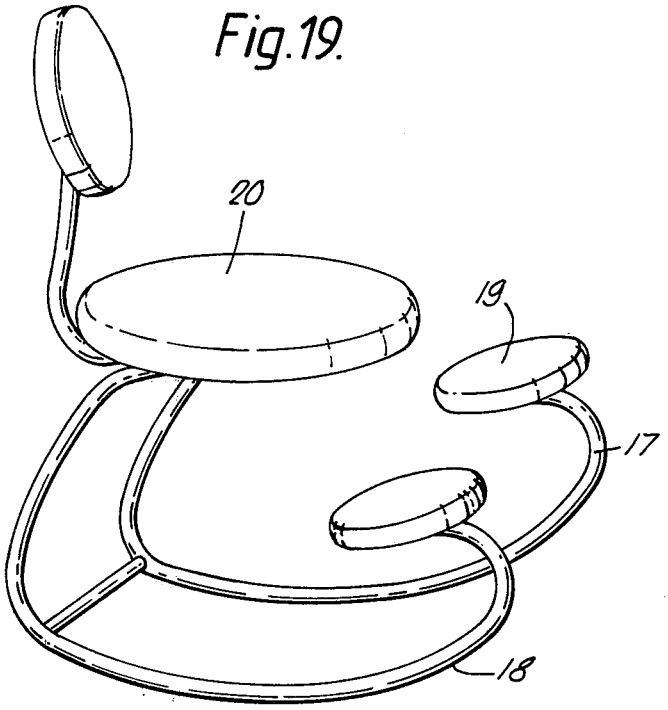
FIG. 19 is a modification of the sitting device according to FIGS. 7–12.
Figure 20:
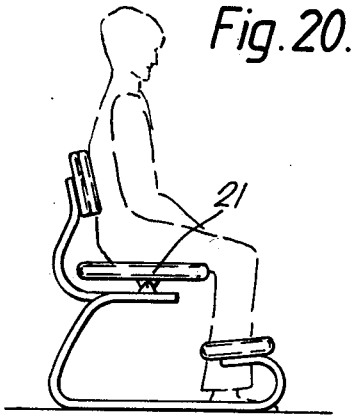
FIGS. 20–24 illustrate a third embodiment of the sitting device according to the invention.
Figure 21:
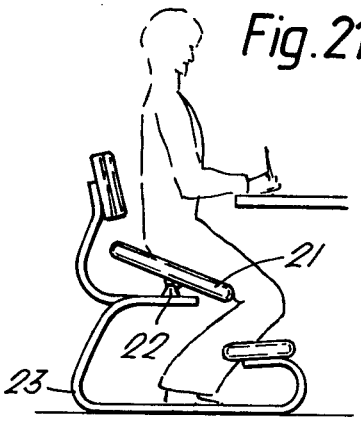

FIG. 19 illustrates a modification of the embodiment according to FIG. 7 where the anchor-like frame is replaced by a frame 17 made from e.g. steel tubes. As in FIGS. 7–12, there is also here curved runners 18. The technical operation of the sitting device according to FIG. 19 is thus substantially identical to that described for the sitting device of FIGS. 7–12. It appears however from FIG. 19 that the supporting means 19 are arranged somewhat higher than in the embodiment of FIGS. 7–12. However, one will immediately understand that the supporting means may be arranged at any suitable distance from the seat 20.

Figure 22:
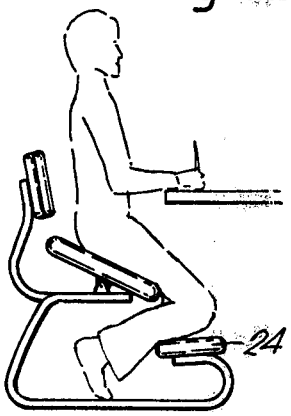
Figure 23:
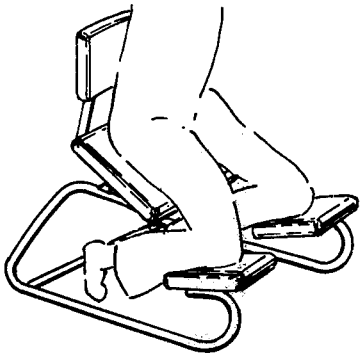
Figure 24:
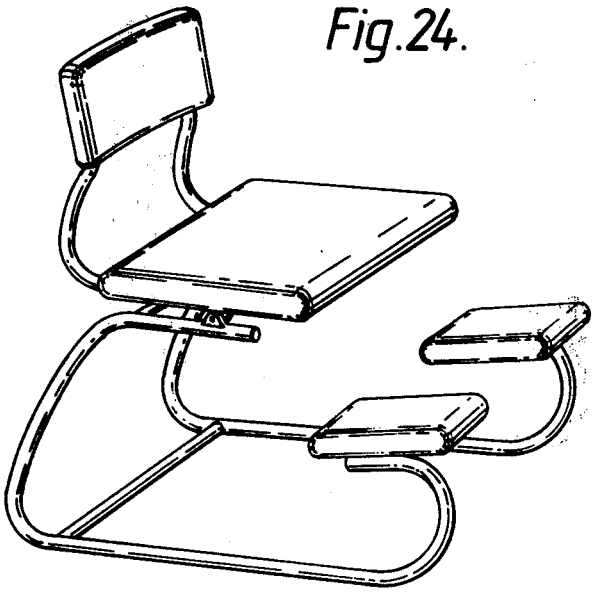

FIGS. 20–24 represent a modification of the office chair discussed earlier. The principle of the office chair appears substantially from FIGS. 20 and 21. The seat 21 is tiltable relative to a frame 23 of the chair about a hinge 22. In FIGS. 22 and 23 the user has placed his calf leg portion against the supporting means 24. In such a sitting posture the user is prevented from sliding off the seat.

There are inter alia two advantages by being able to alternate between the shown sitting postures, viz. that one avoids permanent stress on the same joints, since it is disadvantageous to sit too long in the same posture, and secondly that the different postures cover different functions from e.g. normal posture for reading a book to forwardly inclined work on a table. With the sitting device according to the invention, as shown in FIGS. 7–12 and FIG. 19, one has provided a resting chair which is compatible with the requirements to be set to a working chair. If one are to carry out something at a table, e.g. to eat, when sitting in a deep arm chair, this will prove impossible. This problem is solved by letting the comfortable rocking chair of the present invention upon shifting of the point of gravity of the human body be changed into an ergonomically correct working-chair.

The partly knee-standing posture provides relieving of stresses and will over a length of time prevent certain sufferings in the back. However, the sitting device will also be well suitable for users which have so severe back pains that they only can stand or lie, but not sit in a traditional manner.

We claim:

1. A sitting device comprising:

a frame, a seat for the posterior of a user attached to said frame, said frame including a pair of spaced apart curved runners for contacting the floor whereby the angle of inclination of the seat relative to the floor can be altered, supporting means for the knee or calf leg portion of the user, said supporting means including a respective support arranged at the front end of a said runner, with the supports of the two runners being spaced apart from each other and with a free space from the front between said supports and between the supports and the seat.

2. A sitting device as claimed in claim 1 wherein said runners at a middle portion thereof have at least one bend to cause said device to assume one of at least two possible stable positions in use.

3. A sitting device as claimed in claim 1 or 2 wherein the supporting means have such position and inclination that the user upon resting of his knee or calf leg portions against these may position his feet against the floor or said runners.

4. A sitting device as claimed in claim 1 further comprising a back rest for said seat.

5. A sitting device as in claim 1 wherein said runners have non-interrupted curves.

6. A sitting device as in claim 1 wherein each of said runners has an upwardly extending part at the front thereof with a respective support of said support means being attached to a respective upwardly extending part.

7. A sitting device as in claim 1 wherein said seat is fixedly attached to said frame.

* * * * *